United States Patent [19]

Ito et al.

[11] 4,103,406

[45] Aug. 1, 1978

[54] SPLIT TYPE SECTIONAL FORMING ROLL

[75] Inventors: Tsuneo Ito; Tatuya Hashiba; Takesi Inoue; Kunihiro Nagata, all of Yasugi, Japan

[73] Assignee: Hitachi Metals, Ltd., Japan

[21] Appl. No.: 778,099

[22] Filed: Mar. 16, 1977

[51] Int. Cl.[2] ..... B21B 31/08

[52] U.S. Cl. ..... 29/125

[58] Field of Search ..... 29/125; 100/176

[56] References Cited

U.S. PATENT DOCUMENTS

| | | | |
|---|---|---|---|
| 936,250 | 10/1909 | McDonough | 29/125 X |
| 1,428,142 | 9/1922 | Canda | 29/125 X |
| 1,883,184 | 10/1932 | Weber | 29/125 X |
| 2,720,692 | 10/1955 | Lorig | 29/125 X |

FOREIGN PATENT DOCUMENTS

| | | | |
|---|---|---|---|
| 541,164 | 4/1930 | Fed. Rep. of Germany | 29/125 |

*Primary Examiner*—Alfred R. Guest

*Attorney, Agent, or Firm*—Craig & Antonelli

[57] ABSTRACT

A split type sectional forming roll in which a split roll is formed at least two roll segments, a separating line of a roll segment to have an acute angle in a roll segment section adjacent to a side portion of another roll segment has an angle to a vertical line which is perpendicular to a roll shaft in outer peripheral portion and a separating line parallel to the above described vertical line in inner peripheral portion.

Thereby the roll segments prevents damages of roll such as breakage or chipping out so that this split type sectional forming roll has a longer life sharply.

16 Claims, 9 Drawing Figures

SPLIT TYPE SECTIONAL FORMING ROLL

This invention relates to a split type sectional forming roll which comprises a plurality of roll segments and made up of a desired roll caliber profile working as a unit roll in cooperation.

Generally speaking, a forming roll is needed to be made of high grade materials such as high alloyed special steels to realize proper quality of formability of rolls.

On the other hand, a roll of higher grade material can be made of smaller dimensions due to the higher grade material having greater properties of strength, toughness and wear resistance.

When we can not make an integral roll owing to the fact that the size is too big to make or it is impossible to make a desired roll caliber due to some other reasons, we adopt a split type roll which comprises a plurality of roll segments which make up of a desired caliber profile.

The conventional roll segments that have been generally adopted in split type rolls are as follows:

A split type roll in which a caliber profile is made up of by a combination of roll segments, each having a different profile, namely, a roll segment has an acute angle (hereinafter called a sharp edged roll segment) and another roll segment which has an obtuse angle (hereinafter called a dull edge roll segment) seen in cross section and constitute a part of profile line when they are assembled adjacent to each other, and the conventional split type roll has applied this method to produce the above described roll segments. Therefore, during the period of rolling operation there often arises on an area near the sharp edged roll segment, very high stress concentration exceed an allowable stress limit, so that the sharp edged roll portion have been liable to damage.

In addition, a sharp edged portion of the sharp edged roll segment also tended to be easily damaged during its machining or during assembling work by being struck by working machines or other mill equipment or the like. Actually there occurred many such examples of accidental damage.

Once a roll is damaged, it is necessary to required repair or replace it by a new roll, depending upon the extent of the damage, so that a total roll life is shortened, further a broken roll spoil the work or damages mill equipment. These accidents have been a big problem in roll forming and seriously reduce production efficiency. Also, the roll caliber surface is gradually worn down due to friction between a roll surface and a plate or a strip being rolled, so that the caliber profile gradually deforms.

To restore a worn caliber profile to the original caliber shape, usually the worn roll surface is reground by grinding, so that the roll diameter is reduced accordingly.

Even though the extent of the roll damage is very slight and permits restortion work on the caliber profile, a reduction of diameter by regrinding due to the roll damage is usually from 5 to 10 times that of restortion due to a mere wear.

In other words, even though the damage is very slight, the total roll life will be seriously reduced to 1/5 to 1/10 of an ordinary one. If the damage is very big, the roll life is shortened very severely.

In the conventional split type sectional forming rolls using the aforesaid sharp edged roll segments, due to the drawback that they are easily damaged due to lack of strength of a sharp edged part, it has been difficult to carry out working of the material with sufficient roll-down force, so that roll passing had to be done with somewhat insufficient reduction ration.

A first object of the present invention to provide a split type forming roll having a near square edged roll segment having higher strength, in stead of the conventional split type roll using a combination of sharp-abutted edged rolls, and also satisfying a longer service life and having an improved chipping resistance.

A second object of the present invention is to provide a split type sectional forming roll being capable of heavy duty forming.

According to the present invention, there are improved split type sectional forming rolls having higher strength and a longer roll life.

Figure 1:
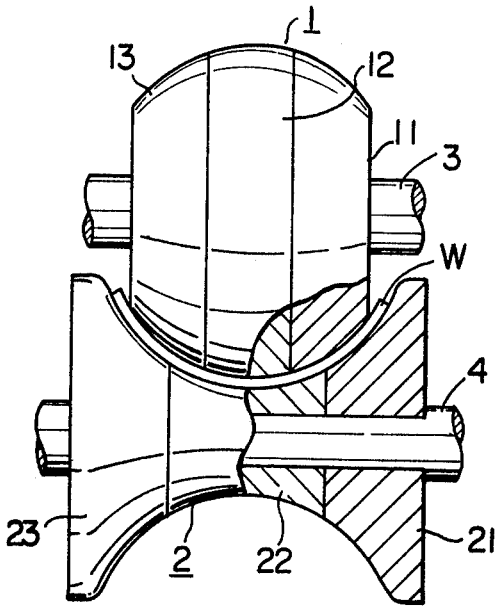
FIG. 1 PRIOR ART
FIG. 1 is an elevation of a conventional split roll.

FIG. 1 is a schematic elevation of a conventional split type sectional forming roll. Convexed roll 1 (upper roll) comprises roll segments 11, 12 and 13, and these are set on a roll shaft 3. Concaved roll 2 (lower roll) also comprises roll segment 21, 22 and 23, and these are set on a roll shaft 4. Convexed roll 1 and concaved roll 2 are face each other and rotate so as to form a strip W into a desirable shape by being passed through a roll caliber gap which is made up of the rolls 1 and 2.

As shown in FIG. 1, convexed roll 1 is separated into three roll segments 11, 12 and 13 and concave roll 2 is separated into three roll segments, similarly. Each roll segment 11, 12, 13, 21, 22 or 23 is separated by a vertical line perpendicular to the roll shafts, respectively, and has a plane side end surface.

Therefore, this type of split roll can be classified as having two different types of roll sections mounted on the same shaft and the sectional portion of said two different roll segments adjacent to each other, one is a sharp edged roll segment and the other is a dull edged roll segment.

Figure 2:
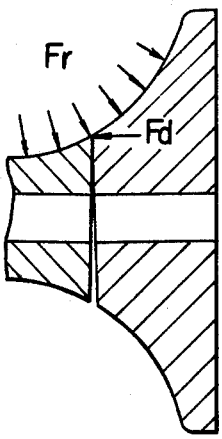
FIG. 2 PRIOR ART
FIG. 2 is a partial cross section of FIG. 1 of a conventional roll and indicate forming forces working on a weak strength area of the roll segment.

As shown in FIG. 2, under the pressing down of co-operating rolls, working force Fr is applied on the roll face as a reaction of the roll pressing down operation.

In FIG. 2, a lower shaft (not shown FIG. 2) is bent due to the force Fr, but as described above, a plurality of roll segments are mounted on the lower shaft to prevent a movement in an axial direction and as indicated FIG. 2 in enlarged scale, the roll segments sometimes contact each other, in the outer periphery of the roll segment under load by the force Fr. A gap between the end surfaces of the two adjacent roll segments becomes maximum at the side ends of the caliber profile opposite to the portion under load of the force Fr.

Accordingly, if a sharp edged roll segment contacts with a adjacent dull edged roll segment while being loaded, a side end outer periphery of the sharp edged roll segment is subjected to a concentrated load by the force Fd due to bending of the lower shaft, in addition to the force Fr.

Usually both the sharp edged roll segment and the dull edged roll segment are made of same material and same quality, so it is apparent that the sharp edge of the sharp edged roll segment turns out to be the weakest point of a whole roll, thus in most cases may be damaged by the combined force of Fd and Fr as described above, so that many defects already described remain unsettled in conventional rolls.

As to the convexed roll, the same is true as in the case of the concaved roll as described above.

An embodiment of the present invention will be described with reference to FIG. 3.

Figure 3:
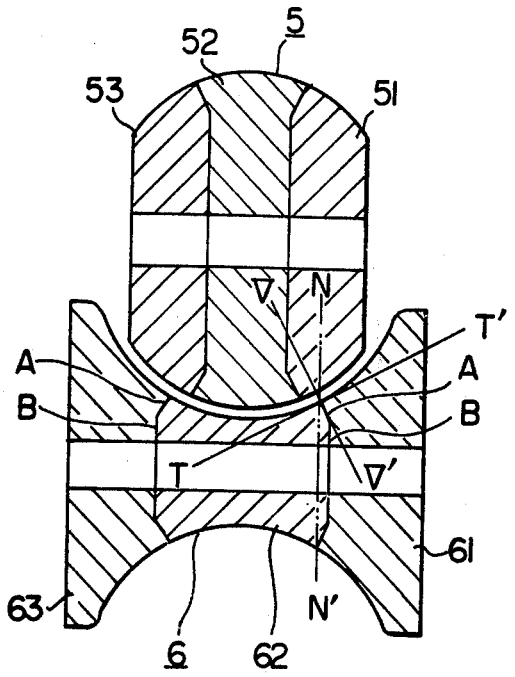
FIG. 3 is a sectional elevation of one of the embodiments of the present invention.

In FIG. 3, line T – T′ is a tangential line at a separating point on a caliber surface of the two roll segments, and line ∇–∇′ is perpendicular to said tangential line T – T′. Line N – N′ is perpendicular to a roll shaft.

A convexed roll 5 comprises roll segments 51, 52 and 53 and a concaved roll 6 comprises roll segments 61, 62 and 63. These are set on upper roll shaft and lower roll shaft, respectively, the same as the conventional split rolls.

The present invention is different from the conventional split rolls with regard to the manner of separating two adjacent roll splits. In conventional split rolls, a roll separating line between two adjacent split roll segments is made straight and perpendicular to the roll shaft, that is, in the conventional split rolls, the roll separating line is parallel to line N – N′, but in the present invention the roll separating line is not straight.

At the side end portions of the sharp edged roll segment, the portion near the caliber profile surface of the segment is not formed to be separated parallel to a geometric vertical line N – N′ perpendicular to the roll shaft, but to form a bent portion of a slant line oblique to the geometric vertical line N – N′ at its outer peripheral portion and is followed by a line towards the vertical line N – N′ parallel to the axis of the roll at its inner part of the roll segment.

A split type sectional forming roll comprises a plurality of roll segments assembled together on a shaft to constitute a desired roll caliber profile, two adjacent roll segments mate slidably with a slight gap at their convex-concave frusto-conical mating surfaces, being tapered near the outer peripheral portions of the segments and being plane perpendicular to the axis of the roll shaft at their inside portions, a slant line representing the tapered portion of the frusto-conical mating surface in its cross section inclines to the geometric vertical line N – N′ which is perpendicular to the roll shaft and passes over the separating point on a caliber surface of the two adjacent segments and lies, with respect to said vertical line at the same side of the geometric normal line ∇ – ∇′ within the cross section of the roll segment, said geometric normal line ∇ – ∇′ being perpendicular to the tangential line T – T′ at the separating point on a caliber surface of the two adjacent segments.

A fundamental feature of the present invention is to provide a frusto-conical parting surface to avoid a sharpned profile line between the two adjacent roll segments, and instead of a flat parting surface of the roll segments of the conventional type split roll.

Above mentioned frusto-conical parting surface is formed by a tapered cylindrical surface A and a flat surface B perpendicular to the axis of the roll.

Figure 4:
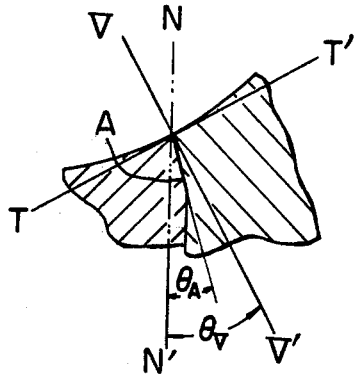
FIG. 4 is a detailed cross section of FIG. 3.

The extent of the advantages brought about by this feature vary greatly depending upon many factors such as operating conditions, grade of the material to be used, design factors defined by the balance between the dimension of the relevant component parts, but this will be explained hereafter by referring to the accompanying FIG. 4. FIG. 4 is a enlarged picture of FIG. 3 showing a part adjacent to the portion where line T – T, line ∇ – ∇′, line N – N′ and the slant line cross.

The following equation represents the relation between an angle $\theta_V$, crossing line N – N′ and line ∇ – ∇′ and an angle $\theta_A$, crossing line N – N′ and slant line A.

$$\theta_A = \theta_V \pm \theta_V = (1 \pm )\,\theta_V = K\theta_V$$

Quality ranking of the split roll of this invention in terms of constant K is as follows:

| K | Quality ranking |
|---|---|
| 0.4 – 1.6 | Better |
| 0.7 – 1.3 | Further better |
| 0.9 – 1.1 | Best |

Figure 5:
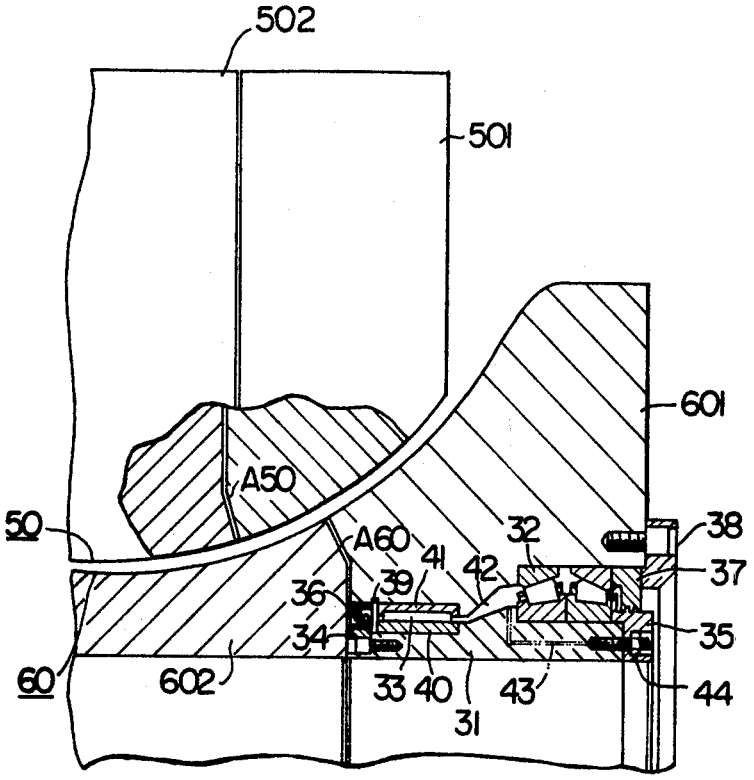
FIG. 5 is a partial elevation of another embodiment of the present invention.

FIG. 5 is another embodiment of the present invention. A convexed roll 50 comprises two roll segments 501 and one roll segment 502 and roll segment 502 is set between two roll segments 501. Similar to roll 50, a concaved roll 60 comprises two roll segments 601 and roll segment 602 is set between two roll segments 601. This is very similar to the embodiment shown in FIG. 3. Different point of the embodiment in FIG. 5 from that of FIG. 3 are that roll segments 501 and 502 which constitute a part of convex roll 50 are separated by a narrow gap within a value permissible for roll forming so as to the two segments do directly contact each other, and roll segments 601 and 602 of the mating concave roll 60 are also by a gap in a same manner as in the case of roll segments 501 and 502. Roll segments of idle rolls 501 and 601 are able to rotate freely on the roll shaft with a mechanism consisting of some bearings and some accessaries as shown FIG. 5. The rolls 50 and 60 comprise a pair of driving roll segments and two pairs of idling roll segments.

In FIG. 5 an idling section roll comprises a flange roll segment 601, a sleeve 31, a dual thrust roller bearing 32, needle roller bearing 33, side cover 34 and 35, an oil seal 36, a labyrinth packing 37, a supporting plate 38 and a stopper ring 39, rotatably supported through the dual thrust taper roller bearing 32 and the needle roller bearing 33. The sleeve 31 is secured to the driving shaft by means of key. The needle roller bearing 33 is provided on the sleeve 31 on the smaller diameter side of the flange roll segment 601 and in order to prevent axial displacement the inner race 40 thereof is held in abutting engagement with the side cover 34 and the outer race 41 thereof is set in position by the stopper ring 39. The oil seal 36 is provided on the smaller diameter side of the flange roll segment 601 for sliding movement on the side cover 34. The dual thrust taper roller bearing 32 is provided on the sleeve 31 on the larger diameter side of the flange roll segment 601 and held against axial displacement by the side cover 35. The labyrinth packing 37 is supported by the dual thrust taper roller bearing 32 and the supporting plate 38 and is relatively slidable around the side cover 35. An oil passage 42 is defined by the flange roll segment 601 and the sleeve 31 between the dual thrust taper roller bearing 32 and the needle roller bearing 33, for the passage of lubricant oil therethrough. Reference numeral 43 designates a lubricating oil passage for feeding the lubricating oil from an oil cup 44.

Figure 6:
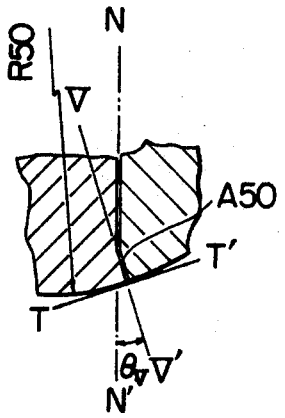
FIG. 6 and FIG. 7 are detailed cross sections of FIG. 5.

FIG. 6 is a detailed view of a slant line A50 of FIG. 5. In this case the slant line A50 is perpendicular to the tangential line T – T' at a separating point on the caliber surface of roll 50 and is included in line ∇–∇'. Therefore an angle $\theta_A$ formed by a line N – N' normal to the axis of convex roll 50 and slant line A50 is equal to an angle $\theta_V$ in formula $\theta_A = K\theta_V$ formerly described, therefore, in this case K is 1 and is ranked "best", and can be said to be the best mode of the embodiment of this invention.

Figure 7:
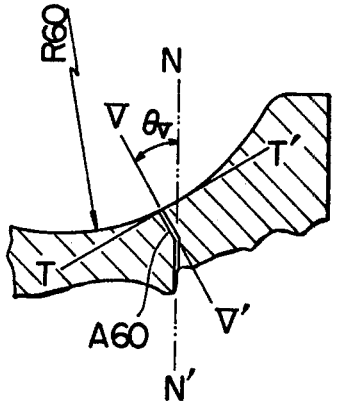

FIG. 7 is a detailed view of slant line A60 of FIG. 5. In this case, K is also 1 for the same reason as above described and is also ranked "best".

This is the embodiment to produce maximum advantage of the present invention. In FIG. 5 roll segment 501 to form convex roll 50 is assembled in the same manner as in assembling the supporting mechanism is not indicated with a full line. In an embodiment shown in FIG. 5 a necessary clearance between roll segments is provided but this clearance has to be set within a very small value, so there sometimes occur damage to bearing during its running due to an unbalanced load or shock, or undesired condition shown FIG. 2 may also arise at an outer peripheral end of the adjacent roll segment due to a severe defection or bending of the roll spindle during operation. Even in normal operation which is not accompanied by such damage as above, it is still desirable to reduce the extent of residual prestress by means of appropriate heat treatment the roll segment and care should be taken not to have any sharp and pointed edges or corners, thereby attempting to decrease the coefficient of working stress concentration as much as possible, which, in turn, improves the total toughness upto the highest level as can be expected.

It is indispensable for the designers concerned to take the slant length of outer periphery of side end of roll segment into consideration, and to have balanced dimensions by taking contributing factors such as the slant angle, diameter, width, profile of the roll segment and the properties of material to be used into consideration.

Figure 8:
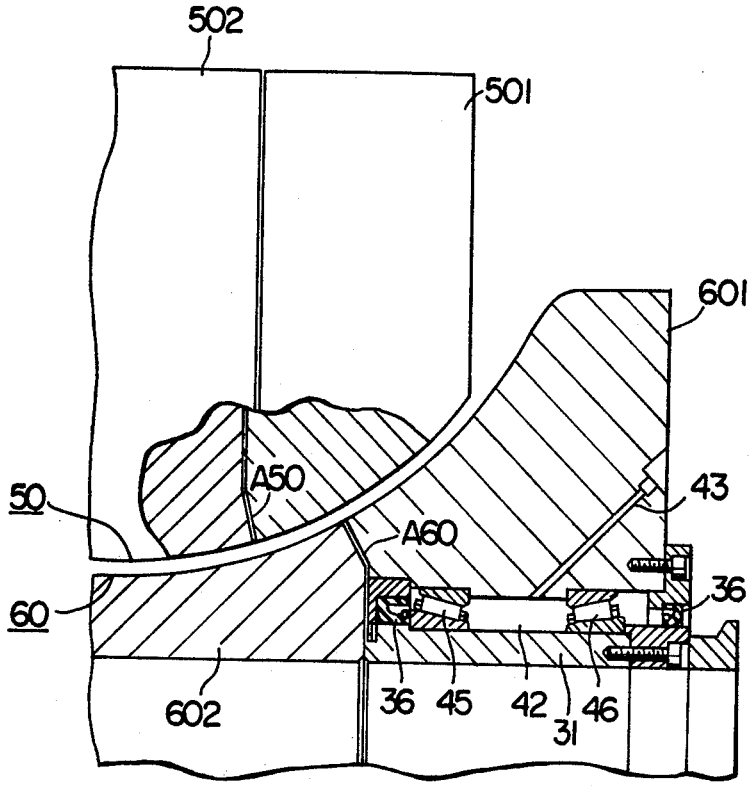
FIG. 8 is a partial elevation of another embodiment of the present invention.

FIG. 8 is another embodiment of the present invention. Similarly to FIG. 5, in a section of the sharp edged roll segment the separating line of outer periphery of side end of adjacent roll segment has the angle to the vertical line N – N' in the outer peripheral portion and is parallel to the vertical line N – N' in inner peripheral portion, further, an idling section roll comprises roll segments 501 and 601 as an idling partial section roll. A flange roll segment 601 is rotatably supported through a pair of axially spaced roller thrust bearings 45 and 46 to interpose between the flange roll 601 and sleeve 31 to fix a drive shaft with key. An outer side of thrust roller bearings 45 and 46 are arranged a set of lubricant seal means 36 respectively.

Figure 9:
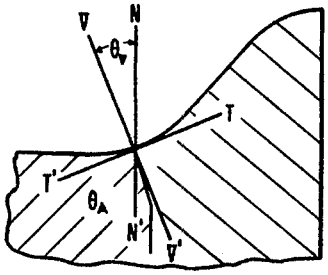
FIG. 9 is a detailed cross section of a sectional elevation of another embodiment relating to the caliber of the present invention.

FIG. 9 is a partial cross sectional elevation of another embodiment of the present invention to the caliber profile of a curved and straightened roll.

As mentioned above, none of the roll segments of the split roll of this invention have any sharp edged corners near the caliber surface and thus aims to equalize the strength which is greatly effected by the shape of the roll segments, thus there exist no weak point with respect to the strength of the rolls in other words, the roll segment of the split roll of this invention has improved resistance to breakage and also has other superior advantages as mentioned hereafter.

Some embodiments of the present invention have been explained which consist of three roll segments, which constitute a roll caliber of a desired configuration and size when they are assembled together on a roll shaft.

But, these embodiments are not to be interpreted as limitative of the scope of the present invention.

The explanation of the present invention, has been mainly stated in respect to the lower split roll, but it goes without saying that the concept of the present invention also can be applied for a upper split roll and, even though a position of the upper and lower split rolls are inverted or upside down or the left side is changed to the right side the objects, functions and advantages of the present invention can similarly be displayed.

The same is true for the case where whole roll segments of a split roll are driven, entirely, not driven or partly driven, wherein the object, function and advantage of the present invention can also be surely accomplished.

Meritorious effects of the present invention are as follows:

1. No roll segments constituting a split roll have any sharp edges or corners, so that no roll damage that occurred in the conventional split roll such as breakage or chipping out will arise.

2. Total roll life of the split rolls according to the present invention will be greatly prolonged over that of the conventional split rolls, and repair cost of a damaged roll or adjustment cost for a substitute roll is reduced, because following problems are not encountered in the split roll of this invention.

(A) Even if damage occurring in the conventional split roll is relatively slight and repairable, repairs are carried out by machining work such as cutting, grinding and the like to remove the damaged caliber portion of outer periphery of the split roll and to restore a desired caliber profile, this work naturally results in, an inevitable reduction of the outer diameter of the split roll as compared with that of before repair.

The extent of this reduction of the outer diameter the split roll is usually larger than, say several ten times of that of the roll which is not damaged but is merely worn down over a long period of using.

(B) Whichever one roll segment which constitutes a split roll is damaged, all the roll segments assembled on the same roll shaft must undergo repair in order to provide uniformly reduced outer diameter of the roll sections including the roll segments which were not damaged.

(C) If the extent of the damage is serious and it is not possible to make a repair, a new substitute split roll must be replaced therefor.

3. Production efficiency will be greatly increased by using the split roll of the present invention over the conventional split rolls, this is because of the fact that it is possible to cut down dead time due to roll damage during the running and also possible to decrease the number of rejects such as scratched tubes or deformed tubing caused by the damaged split rolls.

4. The need to prepare or store spare roll segments against possible roll damage is greatly reduced so that can extra roll cost or loss time for roll changing can be saved.

What is claimed is:

1. A split type sectional forming roller comprising a plurality of roll segments assembled together on a roll shaft to constitute a desired roll caliber profile, including at least one curved section, at least two adjacent segments of said plurality of roll segments mating along surfaces which are convex-concave frusto-conical and intersect at said curved section, wherein inner planar portions of said mating convex-concave frusto-conical surfaces extend perpendicularly with respect to the longitudinal axis of said roller shaft and wherein outer slanting portions of said convex-concave frusto-conical mating surfaces extend obliquely with respect to both the longitudinal axis of said roller shaft and a line which is both oblique with respect to said longitudinal axis and tangential with respect to the roll caliber profile at the peripheral point of said profile at which said frusto-conical surfaces mate, said slanting portions extending at an angle $\theta_A$ included in an angle $\theta_V$ formed between lines passing through said peripheral point which are normal to said tangential line and to said longitudinal axis, respectively.

2. The split type sectional forming machine roll as claimed in claim 1, wherein said roll caliber profile is a convex curved roll caliber profile.

3. The split type sectional forming roll as claimed in claim 1 wherein said roll caliber profile is a concave curved roll caliber profile.

4. The split roll as claimed in claim 1, wherein the roll caliber profile is composed of a curved and a straightened roll caliber profile in cross-section of the roll.

5. The split type sectional forming roll as claimed in calim 1, wherein said angle $\theta_A$ and said angle $\theta_V$ are expressed by a formula $\theta_A = K\theta_V$, wherein K is a constant and the value of the constant K exists between 0.4 and 1.6.

6. The split type sectional forming roll as claimed in claim 5, wherein the value of the constant K exists between 0.7 and 1.3.

7. The split type sectional forming roll as claimed in claim 5, wherein the value of constant K exists between 0.9 and 1.1.

8. The split type sectional forming roll as claimed in claim 7, wherein one or more of the said roll segments is driven and the remaining of the roll segments to be made idle separately.

9. The split type sectional forming roll as claimed in claim 8, which further comprises a sleeve fixedly mounted on a driving shaft; two sets of bearings provided between said sleeve and said roll segment, one of said two sets of bearings is a needle roller bearing provided on a smaller diameter side of said roll segment and the other set of bearing provided on a larger diameter side of said roll segment being thrust roller bearings; an oil passage being arranged to communicate between said needle roller bearing and said thrust roller bearing being capable of supplying lubricating oil from any oil supply means; and a set of oil seals exteriorly provided to each of said needle roller bearing and said thrust roller bearing respectively.

10. The split type sectional forming roll as claimed in claim 8, which further comprises a sleeve fixedly mounted on a driving shaft; a set of thrust roller bearings being arranged to space to the direction of the roll shaft between said sleeve and the roll segment; and a set of oil seals exteriorly provided to each of said thrust roller bearing.

11. The split type sectional forming roll as claimed in claim 7, wherein said roll segments are assembled together on a non-driven roll shaft.

12. The split type sectional forming roll as claimed in claim 1, wherein said roll segments are assembled together on a non-driven roll shaft.

13. A split type sectional forming roller according to claim 1, wherein said convex-concave frusto-conical surfaces slidably mate with a slight gap therebetween.

14. The split type sectional forming roll as claimed in claim 13, wherein one or more of the said roll segments is driven by a roll shaft and the remaining of the roll segments to be made idle separately.

15. A split type sectional forming roller according to claim 1, wherein said convex-concave frusto-conical surfaces slidably mate with a slight gap therebetween.

16. A split type sectional forming roll as claimed in claim 15, wherein one or more of the said roll segments is driven by a roll shaft and the remaining of the roll segments to be made idle separately.

* * * * *